US006025023A

United States Patent [19]

Valente et al.

[11] Patent Number: 6,025,023

[45] Date of Patent: Feb. 15, 2000

[54] METHOD FOR DECORATING STONE-LIKE MATERIALS AND A MACHINE FOR CARRYING OUT THIS METHOD

[76] Inventors: Gabriele Valente, Via Sirtori, 7, Verona, Italy, I-37128; Alberto Lamacchi, Via del Lavoro, 36/b, Sommacampagna, Italy, I-37066

[21] Appl. No.: 09/219,114

[22] Filed: Dec. 23, 1998

Related U.S. Application Data

[63] Continuation of application No. PCT/IT97/00131, Jun. 10, 1997.

[30] Foreign Application Priority Data

Jun. 28, 1996 [IT] Italy ..... VR96A0060

[51] Int. Cl.[7] ..... B05D 1/28; B05D 3/02

[52] U.S. Cl. ..... 427/256; 427/280; 427/294; 427/314

[58] Field of Search ..... 427/256, 280, 427/281, 287, 284, 314; 134/2; 101/487, 491

[56] References Cited

U.S. PATENT DOCUMENTS

| | | | |
|---|---|---|---|
| 3,816,319 | 6/1974 | Sarot et al. | 252/95 |
| 4,172,418 | 10/1979 | Durand . | |
| 4,174,250 | 11/1979 | Durand | 156/583.3 |
| 4,406,662 | 9/1983 | Beran et al. . | |

FOREIGN PATENT DOCUMENTS

| | | |
|---|---|---|
| 791476 | 8/1997 | European Pat. Off. . |
| 26 42 350 | 3/1978 | Germany . |
| 58205057 | 3/1983 | Japan . |
| 1 463 596 | 2/1997 | United Kingdom . |
| 96 18509 | 6/1996 | WIPO . |
| 96/18509 | 6/1996 | WIPO . |

*Primary Examiner*—Fred J. Parker
*Attorney, Agent, or Firm*—Oppenheimer, Wolff & Donnelly LLP

[57] ABSTRACT

A process for decorating and/or coloring tile- or slab-shaped stone-like artificial or composite materials comprises the application of one or more sublimate colors to the surface to be decorated and/or colored, said application being carried out at a temperature range from about 50° C. to 250° C., said sublimate colors being supported on a suitable carrier. A natural or synthetic resin is mixed into the original composition of said artificial material in order to enhance the migration of color pigments through the tile or slab surface during the sublimation process. Thereby a good penetration of the color into the slab is achieved, and the color is still visible even after having removed the polished surface of the slabs by means of grinding.

21 Claims, 1 Drawing Sheet

METHOD FOR DECORATING STONE-LIKE MATERIALS AND A MACHINE FOR CARRYING OUT THIS METHOD

"This application is a Continuation of International application Ser. No. PCT/IT97/00131, filed Jun. 10, 1997, which application is incorporated herein by reference."

TECHNICAL FIELD

The present invention relates to a method for decorating stone-like materials.

More precisely, the present invention relates to a method which enables a permanent colour decoration or design to be transferred on to stone-like materials, generally constituted by tiles, floor slabs or bricks, panels and the like, such materials being artificial or composite and which are in any case suitable for obtaining floors, coverings or memorial applications such as tombstones.

Furthermore, the invention relates to a machine for carrying out said method.

The invention is mainly applied in the field of industrialised buildings.

BACKGROUND ART

A known method for manufacturing panels or slabs in agglomerate materials, for example constituted by marble and/or sand and/or quartz and/or different small decorative elements (metals, glass, ceramics, wood, precious stones and the like), or granites, quartzes or sands bonded with predetermined quantities of bonding resins comprises various working phases, and more precisely:

- a first phase in which the various materials constituting the agglomerate are crushed;
- a second phase wherein the crushed materials are mixed in order to obtain a product as homogeneous as possible, during which phase the bonding resins are added;
- a third phase of molding and compacting the agglomerate, during which the correct shape is achieved;
- a fourth phase of panel hardening, carried out at a predetermined temperature;
- a fifth phase in which both faces of the panel are subjected to dressing and polishing;
- a sixth phase during which the panel is cut to size, chamfered, gauged and countersunk, and after which the final products are discharged.

Such a method allows panels or slabs in agglomerate materials to be manufactured, which possibly include decorative elements which dignify the appearance of the finished product, said panels or slabs having carefully predetermined lengths, widths and thicknesses; said method is continuously carried out by a special machine.

It has to be stressed that the resins which are used for carrying out such a method play the unique role of bonding the crushed stone particles together; in order to perform this task, several different kinds of bonding resins are used, e. g. polyurethanic, epoxydic, phenolic resins.

However, such a method does not allow the surface coloration or decoration of the slab or panel to be modified at one's choice after its manufacturing.

Document GB-A-1,463,596 discloses a process for colouring a metal or a rigid non-metallic substrate having a surface containing an epoxy resin, said process comprising the following phases: contacting said surface with a temporary carrier bearing one or more vaporisable or sublimable dyestuffs; heating such a combination in order to transfer the dyestuff or dyestuffs from the carrier on the the surface to be coloured; and then removing the temporary carrier.

Besides, document U.S. Pat. No. 4,174,250 discloses an apparatus and a method for imprinting articles, e.g. tiles, by means of the sublimation transfer of dyes into a dye receptive plastic resin surface.

Other methods are known which allow the surface of slabs to be dignified, for example in the case where they would exhibit cracks, fissures or the like.

In this case the exposed surfaces are treated with natural or synthetic resins which penetrate into the cavities; the surface is then carefully polished.

In this case, too, it is not possible to decorate or colour the exposed surface of the material, which is generally shaped as slabs or tiles.

Moreover, according to another method known in the art, the exposed surface of tiles or slabs formed by mixtures of natural materials, such as marble, stone, granite, undergoes a surface polishing treatment, by means of products containing a polyester resin or at least enriched therewith; thereafter, a colouration process of said exposed surface is carried out GB-A-1444368 relates to a process for the transfer printing of ceramic tiles provided with a coating of a synthetic resin, said synthetic resin having affinity for sublimate disperse dyestuffs.

FR-A-2521489 discloses a process for thermal transfer of sublimate colours on supports which are previously coated with synthetic resins.

U.S. Pat. No. 4,406,662 deals with a process of heat transfer for printing the surface of a filled polymeric article using sublimable disperse dyes.

FR-A-2380901 discloses a process for producing decorated water resistent panels having a polymeric transparent coating, said polymer being advantageously a polyester resin.

U.S. Pat. No. 4,172,418 deals with an electrostatic method and apparatus for carrying out sublimation printing of a substrate wherein a matrix comprising the design to be printed is electrostatically charged in a given polarity and a fine disperse dye powder, oppositely charged, is brought into contact with said matrix.

DESCRIPTION OF THE INVENTION

The present invention aims to provide for a new method which enables artificial and/or composite tile- or slab-shaped materials to be permanently decorated or coloured, by impressing on the exposed surface thereof and for a given depth, inside of the material, a desired colour or decoration.

This is achieved by means of a method having the features described in the main claim.

The dependent claims describe particularly advantageous forms of embodiment of the method according to the invention.

Furthermore, the present invention aims to provide for a machine which enables said method to be carried out on industrial scale.

This is achieved by means of a machine for providing the application of a sublimate color on a tile- or slab-shaped stone-like artificial or composite material. The machine comprises a movable or fixed work plane on which the material is placed, a pressing group, a heating unit for heating the material or a head of said pressing group, as well as a feeder for placing a carrier for sublimate colors in sheet- or continuous-band-form between the head of the pressing group and said material. The pressing group is driven by pneumatic and/or hydraulic and/or oleodynamic means. The head of the pressing group is made of a metallic material, advantageously an aluminum alloy, or of the textile material. The work plane is constituted by an intermittent conveyor.

According to the present invention, the method which is provided for decorating and/or colouring slab-formed materials comprises the heat transfer of a sublimate colour on the exposed surface of said materials, said sublimate colour being carried by a suitable carrier which is generally constituted by transfer paper in the form of sheets or bands.

Said method, which is carried out at predetermined temperatures and for predetermined periods of time, enables the sublimate colour to be permanently transferred on the material surface, up to some microns depth inside of it.

In such a way it is possible to decorate, to colour or to dignify the material surface without lowering its physical-mechanical features, e.g. hardness, trampling resistance, etc.

DESCRIPTION OF THE DRAWING

Other features and advantages of the present invention will be apparent from the reading of the following description, which is provided in the form of a non-limiting example, with the help of the FIGURE shown in the attached drawing, said figure representing a schematical side view of a machine for industrial use for carrying out the method according to the invention.

DESCRIPTION OF A FORM OF EMBODIMENT

Figure 1:
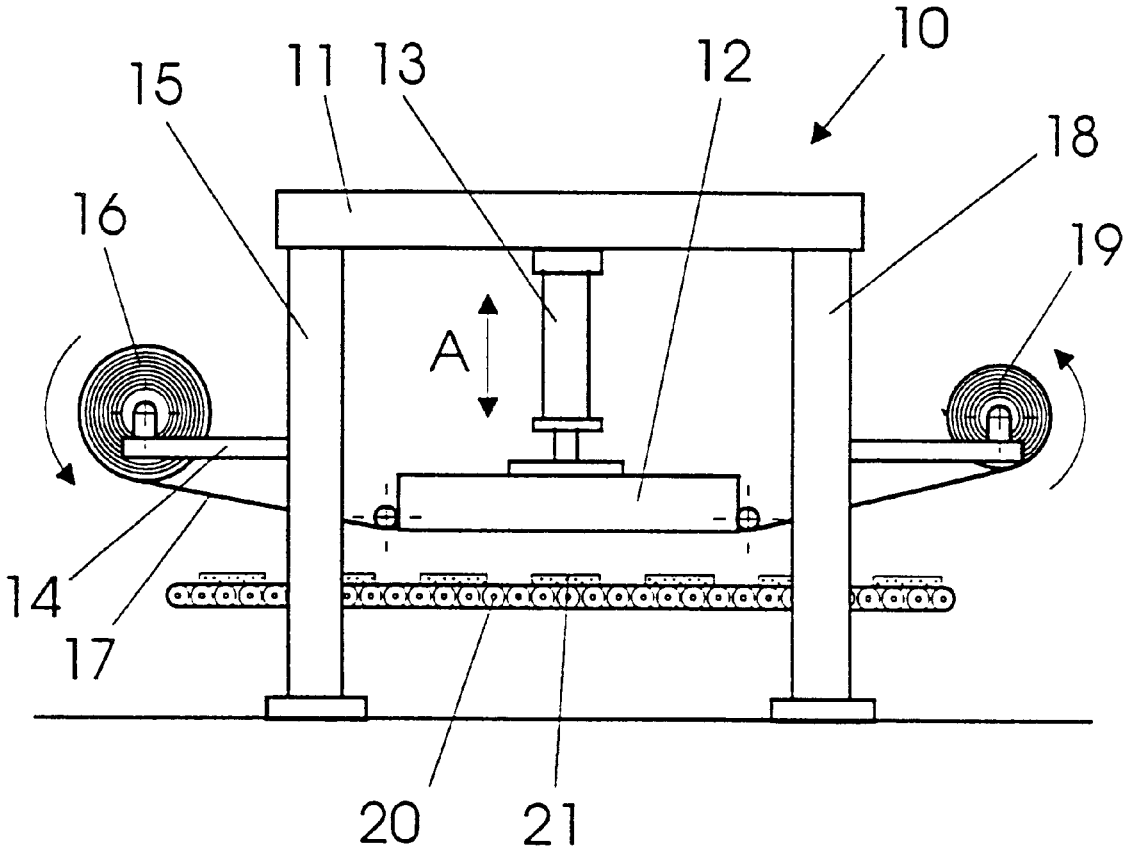

In the FIGURE, reference sign 10 generally indicates a machine for industrial use which is suitable for carrying out the method for decorating and/or colouring slab-formed materials according to the invention.

According to said form of embodiment, the machine 10 comprises a support frame 11 on which a pressing group 12 is assembled, said pressing group 12 being operated, e.g. by a jack 13, in order to perform a vertical movement as indicated by the arrow, and exhibiting a pressing surface constituted, for instance, by an aluminium alloy sheet or by a stratified material having a textile covering.

A first pair of supports 14, rigidly fixed to the uprights 15 of the frame 11, bears a first drum 16 on which a band 17 of sublimate colour transfer paper is wound, said sublimate colour transfer paper being for instance of the type produced by Confalonieri F.lli Di Mario S.p.A., Bergamo (Italy) and acts as a support film for the sublimate colour.

A second pair of supports is assembled on opposite uprights 18 of the frame 11, said supports bearing a second drum 19 on which said band 17 is rewound after having been unwound from the first drum 16.

The unwinding and rewinding path of the band 17 is shown in the FIGURE, and it can be noted that the band 17 passes below the pressing group 12 which, according to a particularly advantageous form of embodiment of the invention, is internally provided with heating means, e.g. electric resistances.

According to the form of embodiment shown in the FIGURE, the pressing group 12 operates on a work plane which in this case is constituted by a conveyor 20, e.g. a conveyor provided with an intermittent advancing motion.

A series of slabs or tiles or floor bricks 21 made of an artificial or composite stone-like material is carried on said conveyor 20, as coming from other preceding working stations.

According to the specific form of embodiment shown in the FIGURE, the process according to the invention is carried out by unwinding a predetermined quantity of band 17 from the first drum 16, temporarily stopping the conveyor 20 and simultaneously lowering the pressing group 12 on the tiles or slabs 21.

The application of the pressing group 12 for a predetermined period of time (which generally varies from a few seconds to about a minute) on the surface of the tiles or slabs 21 (or at very short distance from it), together with a simultaneous heat transfer (the process is carried out at temperatures ranging from about 50° C. up to 250° C., according to circumstances), causes the sublimation of the colour pigments from the band 17 to the surface of the tiles or slabs 21.

Such a process allows the colour pigments to penetrate into the material surface for a depth of some microns, ensuring a permanent coloration or decoration of the exposed surface of said tiles or slabs 21.

The above-described machine 10 allows the process according to the invention to be carried out in an industrial plant for continous production of slabs or the like made of artificial or composite stone-like material.

The machine 10 can be made suitable for other working situations according to any particular need.

For instance, the machine 10 can be provided with means (not shown in the FIGURE) constituted by an external structure and a vacuum pump, said means allowing the colour transfer process to be carried out under vacuum or at a pressure in any case lower than the atmospheric pressure, which is advantageous for the resulting quality of the colour transfer.

Furthermore, the machine can be provided with a fixed work plane, instead of operating on a conveyor.

In this case, the slabs made of a stone-like material can be manually transferred on the work plane, or by any other mechanical means, for instance by means of a suitable robot which is provided for lifting the slabs from a conveyor arranged upstream of the machine, for placing them on the work plane and, once the colour transfer process has been carried out, for lifting and placing them on a conveyor arranged downstream of the machine.

The colouring or decorating process according to the invention provides for forms of embodiments which are particularly advantageous and which considerably improve the results in terms of colour transfer process quality.

According to an essential feature of the invention, the stone-like artificial or composite slabs include a resin which facilitates the sublimation process thanks to resin affinity with the colouring material.

According to a particularly advantageous form of embodiment of the invention, said resin is constituted by a polyester resin.

In order to introduce a polyester resin inside of the slabs, it is possible to include it into the original slab mix during the production of artificial materials.

Said resin, particularly polyester resin, is not in the form of a coating of the material surface as disclosed in the cited prior art, but is directly introduced in the material matrix allowing an advantageous and excellent transfer of the sublimate colour.

Tests carried out by the Applicant could ascertain that in the case of artificial floor slabs obtained by using an original mixture containing less than 10% of polyester resin, a good penetration of the colour into the slab is achieved, and the colour is still visible even after having removed the polished surface of the slabs by means of grinding.

According to an advantageous and preferred form of embodiment, the colour transfer process is carried out by applying a predetermined pressure, preferably comprised between few hundreds gr/cm$^2$ and several Kg/cm$^2$ (up to the breaking limit of the stone-like material) on the slab surface by means of the pressing group 12.

In many cases, such a feature lowers the colour transfer time and allows a deeper penetration of the colour into the stone-like material.

The process according to the invention can be even more effective by carrying out further treatments on the stone-like slabs.

A first treatment, to be carried out before the colour transfer operation, is constituted by pre-washing and drying the slabs and this may take place, in an industrial plant in which the slabs are moved by special conveyors, as shown in FIG. 1, by means of a pre-washing machine (not shown in the FIGURE).

Here the slabs are sprayed with a suitable pre-washing liquid which, according to a particularly advantageous form of embodiment, is constituted by a dimethylglyoxime mixture,.

Downstream of such a pre-washing machine, the slabs are dried in a further working station (not shown in the FIGURE), which is provided, for instance, with a bank of fans; the slabs are then conveyed to the machine 10.

According to a further advantageous preferred form of embodiment, a pre-heating kiln (e.g., of electric or air-heating or infrared type) is located directly upstream of the machine 10; inside of said kiln the slabs are brought up to a temperature preferably comprised between 50° C. and 250° C., which allows or enhances the sublimation process.

Moreover, according to a further form of embodiment, a slab washing machine (not illustrated) is located directly downstream of the machine 10.

The washing operation, which is carried out after the colour transfer, allows any possible residual particles to be eliminated, and gives the slabs a good brightness.

Said operation is particularly effective in the case where a glycol-based washing product is used.

According to the above description, it appears that the process according to the invention enables artificial and composite stone-like materials to be coloured or decorated with any desired colour or decoration.

This implies some advantages which exceed the mere aesthetic improvement.

Indeed, the process according to the invention enables an industrial-scale production of slabs having a basic colouring to be achieved, whereby said slabs can successively be coloured or decorated with personalized patterns or according to specific requests.

We claim:

1. A process for decorating and/or colouring a tile or a slab formed of a composite artificial material, comprising application of one or more sublimate colours to a surface of the formed artificial material to be decorated and/or coloured, said application being carried out at a temperature range from about 50° C. to 250° C., said sublimate colours being supported on a carrier, and wherein a resin is introduced into and mixed with an agglomerate material and an original mix composition of the artificial material prior to forming said artificial material into a tile or slab in order to enhance the migration of colour pigments through the tile or slab surface during the sublimation process.

2. A process according to claim, 1, wherein said resin is a polyester resin.

3. A process according to claim 1, wherein said formed artificial material is washed and dried before carrying out the colour sublimation process.

4. A process according to claim 3, wherein the washing operation is carried out by using a mixture containing dimethylglyoxime.

5. A process according to claims 1 or 2, wherein said formed artificial material is heated to a temperature comprised between 50° C. and 250° C. immediately before carrying out the sublimation process.

6. A process according to claim 1, wherein said sublimation process is carried out under vacuum conditions or in an atmosphere having a pressure lower than atmospheric pressure.

7. A process according to claim 1, wherein said carrier is spaced from the material to be decorated and/or coloured.

8. A process according to claim 1, including pressing a decorated and/or coloured tile or slab at a predetermined pressure, up to the breaking point of the material.

9. A process according to claim 1, wherein said carrier is transfer paper for sublimate colours, said paper being in a form of sheets or continuous bands.

10. A process as claimed in claim 8 wherein a supporting means is pressed against the formed artificial material to a pressure up to the breaking point of the material.

11. A process as claimed in claim 1 wherein the carrier for sublimate colours is either a sheet or continuous band.

12. A process as claimed in claim 8 wherein pressure is applied by one of pneumatic, hydraulic or oleodynamic means.

13. A process as claimed in claim 8 wherein pressure is applied by a head, the head being a metallic or textile material.

14. A process as claimed in claim 1 wherein the composite artificial material is conveyed intermittently through a work plane where pressure is applied by a supporting means to the material to be decorated and/or coloured at a predetermined pressure.

15. A process as claimed in claim 1 wherein the sublimation process permits penetration of the pigments into the material.

16. A process for decorating and/or colouring an artificial or composite stone material comprising the application of one or more sublimate colours to a surface of the stone material to be decorated and/or coloured, said application being carried out in a temperature range from about 50° C. to 250° C., said sublimate colours being supported on a carrier, and wherein a resin is introduced into and mixed with an agglomerate material in an original mix composition of said artificial or composite stone material, thereby to enhance the migration of colour pigments through the surface during the subsequent sublimation process.

17. A process as claimed in claim 16 wherein the agglomerate material includes at least one of marble, sand, quartz or granite.

18. A process as claimed in claim 16 wherein the resin is a polyester resin.

19. A process as claimed in claim 16 wherein a supporting means is pressed against the stone material to a pressure up to the breaking point of the material.

20. A process for decorating and/or colouring a formed material comprising the application of one or more sublimate colours to a surface of the formed material to be decorated and/or coloured, said application being carried out in a temperature range from about 50° C. to 250° C., said sublimate colours being supported on a carrier, and wherein a resin is introduced into and mixed with an agglomerate material beyond only a resin coating on the surface of the formed material to be decorated and/or coloured, thereby to enhance the migration of colour pigments through the surface of the formed material during the sublimation process.

21. A process as claimed in claim 20 wherein the sublimation process permits penetration of the pigments into the material.

* * * * *